United States Patent [19]

Dyama

[11] 4,384,800

[45] May 24, 1983

[54] BALL HOLDER FOR BALL POINT PEN

[75] Inventor: Hirosi Dyama, Ibaragi, Japan

[73] Assignee: Pentel Kabushiki Kaisha, Tokyo, Japan

[21] Appl. No.: 169,184

[22] Filed: Jul. 15, 1980

[30] Foreign Application Priority Data

Jul. 14, 1979 [JP] Japan ..... 54-96975

[51] Int. Cl.[3] ..... B43K 7/10

[52] U.S. Cl. ..... 401/216; 401/209

[58] Field of Search ..... 401/215, 216, 197, 200, 401/209

[56] References Cited

U.S. PATENT DOCUMENTS

| | | | |
|---|---|---|---|
| 3,162,941 | 12/1964 | Young | 401/216 |
| 4,116,569 | 9/1978 | Reed | 401/216 |
| 4,145,148 | 3/1979 | Fukuoka | 401/209 |
| 4,251,164 | 2/1981 | Nakagawa | 401/216 |

FOREIGN PATENT DOCUMENTS

| | | | |
|---|---|---|---|
| 177350 | 1/1954 | Austria | 401/217 |
| 1225176 | 2/1960 | France | 401/216 |
| 263054 | 11/1949 | Switzerland | 401/216 |
| 394866 | 12/1965 | Switzerland | 401/216 |
| 2013581 | 8/1979 | United Kingdom | 401/216 |

*Primary Examiner*—Clyde I. Coughenour

*Attorney, Agent, or Firm*—Robert E. Burns; Emmanuel J. Lobato; Bruce L. Adams

[57] ABSTRACT

A tip for a ball point pen utilizing a water soluble ink is provided, and comprises a ball holder which rotatably supports a ball in a tip end thereof, a ball abutment defined within the ball holder, and an ink passageway providing a communication between the ball abutment and an ink supply path. The ink passage is elongate in cross section. The ball abutment is defined by four flat bearing surfaces which are inclined toward the center of the passageway, two of the bearing surfaces being disposed on each side of the passageway and being directly joined with each other with an angle therebetween, the ball being supported by contact with a point on each of the four bearing surfaces, the joining portions between the bearing surfaces defining an ink reservoir which communicates with the passageway.

6 Claims, 3 Drawing Figures

BALL HOLDER FOR BALL POINT PEN

FIELD OF THE INVENTION

The invention relates to a ball point pen using a water soluble ink, and more particularly, to a ball holder which rotatably retains the ball in the tip end of a pen.

Ball point pens are in extensive use and comprise a ball holder which rotatably retains a ball in the tip end, and a sleeve containing a quantity of ink. The ball holder includes a trap socket defining a cup-shaped cavity in which a ball is rotatably retained, and an ink guide passageway having its front end opening centrally into the bottom of the socket and having its other axial end communicating with the front end of an ink feed path which extends axially from the rear end of the holder toward the tip end. In such a ball point pen, the bottom of the cavity and/or the internal wall of the ink passageway is formed with a plurality of narrow guide grooves. However, these guide grooves may become plugged when foreign matters find their way into these grooves, causing a biased flow of the ink which results in a non-uniformity in the writing. Where an oily ink is used, the viscosity of the ink permits the ink to be applied positively around the ball. However, when a water soluble ink is used, it cannot be applied to the ball in a uniform manner, whereby the letters or symbols being written may become thin. In particular, when a ball of a reduced diameter on the order of 0.6 mm or less is used to provide a slender writing ball point pen, the internal diameter of the cavity is correspondingly reduced to require ink guide grooves of a further reduced size, which further aggravates the problem of plugging.

DESCRIPTION OF THE PRIOR ART

U.S. Pat. No. 3,708,234 assigned to the common assignee a the present application and issued Jan. 2, 1973 discloses a ball holder having an ink reservoir formed in the bottom of a cup-shaped trap socket. The ball holder is formed of a synthetic resin material, and the bottom of the trap-shaped socket is centrally formed with an ink guide passageway which is pentagonal in cross section. A plurality of flat ball bearing surfaces are disposed as an angle with respect to each other in surrounding relationship with the passageway. The ball is supported by a lineal or areal contact with the sidewall of the socket and by a point contact with the respective ball bearing surfaces. In this manner, the ball is freely rotatable, creating a clearance between the ball and the ball bearing surfaces in regions other than the points of contact, which clearance acts as an ink reservoir. Hence, a sufficient ink supply to the reservoir is assured without provision of the usual ink guide grooves to provide an increased area of contact between the ball and the ink as in the prior art. However, as the bearing surfaces are subject to abrasion as a result of writing over a prolonged period of time, these bearing surfaces may be formed with recesses in the form of part of a sphere corresponding to the ball, and hence the ball tends to become supported by an areal contact. As compared with the condition of the ball when it is initially used, the ball has sunk into the socket. This sinkage tends to block the opening of the ink guide passageway, retarding ink flow during the writing operation and resulting in a thinner holograph or letters and symbols being written which change in thickness.

Japanese Utility Model Laid-Open Application No. 53-3634 assigned to the common assignee as the present application and laid open Jan. 13, 1978, discloses an ink guide passageway having substantially rectangular cross section. The length of the cross section of guide passageway is slightly less than the diameter of the ball, and the passageway has a width on the order of 0.1 mm at the opposite longitudinal ends thereof, as measured in a direction perpendicular to the length thereof. The width gradually increases toward the center of the length. The disclosed configuration provides an increased opening area of the guide passageway at the bottom of the socket, permitting an area of contact between the ball and the ink supplied to the passageway to be increased. However, the bottom of the socket is formed with a bearing surface in the form of an inverted frustum of a cone which supports the ball by a lineal contact. Accordingly, as the bottom of the socket is abraded as a result of writing over a prolonged period of time, the bearing surface may be formed with a recess, which supports the ball by an areal contact. Such areal contact removes the ink which has been deposited on the ball, and as a result the ink is deposited onto the ball only through the opposite ends of the guide passageway, thus degrading ink flow during the writing operation.

SUMMARY OF THE INVENTION

It is an object of the invention to provide a ball holder for a ball point pen which is integrally formed of a synthetic resin material to enable a ball having a reduced diameter to be firmly held and which enables a water soluble ink to be used to permit a smooth writing operation without causing an interruption of an ink flow over a prolonged period of use.

In accordance with the invention, there is provided a ball holder for a ball point pen comprising an elongate hollow holder body formed of a synthetic resin material and a ball trap socket integrally formed with the holder body so as to hold a ball at one end of the holder body in a rotatable manner and against removal. The socket has a cavity holding the ball so that the latter partly projects through a tip end of the holder body. The ball holder also comprises an ink guide passageway extending axially from the other end of the holder body toward the cavity. The passageway is elongate in cross section, which has a longitudinal length slightly less than the diameter of the ball, and a width in a direction perpendicular to the length thereof which increases toward the center of the length from its opposite ends. The bottom of the cavity is formed with a plurality of ball bearing surfaces which are inclined downwardly toward the center of the ink guide passageway.

In a preferred embodiment of the invention, the tip end of the socket has an opening of a diameter which is slightly greater than the diameter of the ball, and is provided with a trap edge which is caulked to prevent removal of the ball inserted therein. The bottom of the cavity of the ball trap socket is formed by four flat sector-shaped bearing surfaces, the pivot of each of which is located at the center of the guide passageway and at a lower elevation than the arcuate portion of the sector-shaped bearing surfaces. As a result, a clearance is formed between the internal wall of the cavity, the bearing surfaces and the ball surface to permit a flow of ink thereinto from the longitudinal ends as well as from the central region on the ink guide passageway. In this manner, the clearance functions as an ink reservoir, assuring a satisfactory supply of ink to the ball. If the ball bearing surfaces become abraded as a result of the use of the pen over a prolonged period of time to cause the ball to be recessed into the bearing surfaces or when an areal contact is formed, the fact that the adjacent bearing surfaces adjoin with each other by a substantially V-shaped boundary prevents a continuous, annular band of areal contact from being formed around the passageway.

DESCRIPTION OF PREFERRED EMBODIMENTS

Figure 1:
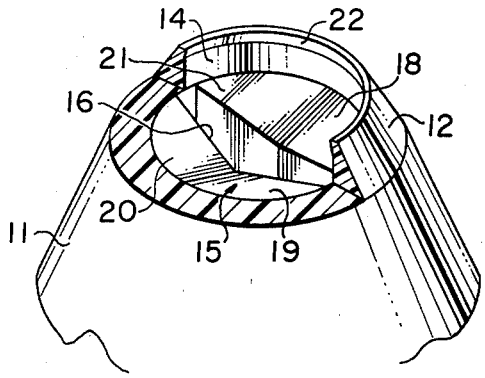
FIG. 1 is a perspective view, partly cut away, of a ball holder for a ball point pen according to one embodiment of the invention.
Figure 2:
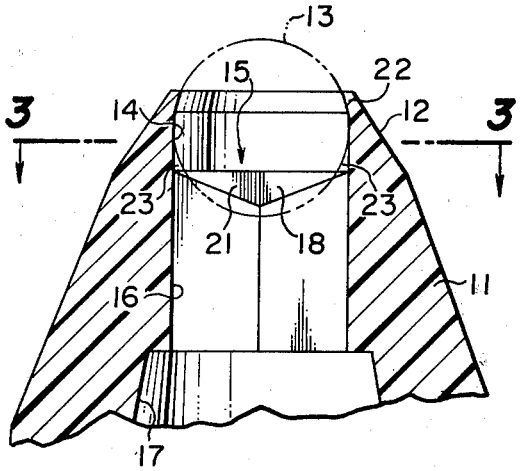
FIG. 2 is a longitudinal section of the ball holder shown in FIG. 1.
Figure 3:
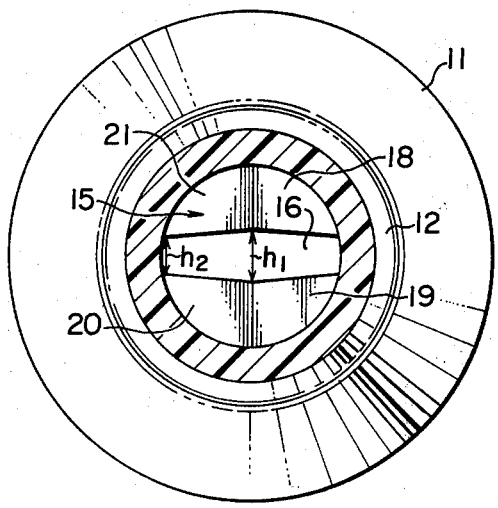
FIG. 3 is a cross section taken along the line 3—3 shown in FIG. 2.

Initially referring to FIGS. 1 to 3, the body of a ball holder is generally indicated by a reference numeral 11, and is formed of polyacetal resin or synthetic resin which is reinforced with glass fiber or carbon. The tip end of the body 11 is formed with a ball-retaining trap socket 12 in which a cavity 14 is defined for holding a ball 13 of a metal or synthetic resin, as indicated by phantom line in FIG. 2. Ball-supporting means in the form of a ball abutment 15 is formed in the bottom of the cavity 14, and one end of an elongate ink guide passageway 16 opens into the center of the ball abutment 15. The other end of the passageway 16 opens into one end of an ink supply path 17. The purpose of the ink supply path 17 is to supply ink to the ink guide passageway 16 from an ink chamber defined within a sleeve (not shown) of a ball point pen, and it may be hollow as shown, or may comprise an ink relay core formed by a bundle of fibers or a thin rod of synthetic resin.

As shown in FIGS. 1 and 3, the passageway 16 has an elongate cross section having a length which is substantially equal to or slightly less than the diameter of the ball 13 and of a width which decreases from a value h1 at the center of the length to a value h2 at the longitudinal ends of the section of the passageway. The ball abutment 15 is formed by four discrete, flat, substantially sector-shaped bearing surfaces 18, 19, 20, 21, having its two sides defined by respective halves of the longer sides of the passageway 16 and a line extending through the center of the longer sides of the section passage 16 in a direction perpendicular to the length thereof. It will be noted that the individual bearing surfaces 18, 19, 20, 21, located on the opposite sides of the perpendicular line, are inclined downwardly toward the center of the passageway 16, and the adjoining bearing surfaces 19,20 and 18,21 are inclined or sloped toward each other. The ball 13 is rotatably supported by point contact with these ball-bearing surfaces 18 to 21. It will be readily understood by one skilled in the art that such bearing surfaces can be easily formed as by an injection molding.

After the ball 13 is fitted into the cavity 14, the tip end of the trap socket 12 is caulked to define a trapping edge 22, thus preventing a withdrawal of the ball 13 from within the cavity 14. Such caulking operation may be achieved by pressing a heated tool against the tip end of the holder 12 while rotating the body 11.

Since the ball 13 is supported by point contact by each of the four bearing surfaces 18 to 21, a clearance 23 is formed between these bearing surfaces, the outer surface of the ball 13 and the internal wall of the socket 12. Hence, these clearance 23 constitute a reservoir for the ink (not shown) flowing through the passageway 16, and a satisfactory supply of ink to the ball is assured through the passageway 16 and the ink reservoir. Since the passageway 16 is rectangular in section, the flow of ink is permitted into the clearances 23 from the opposite longitudinal ends as well as the broader central portion of the rectangular section of the passageway where the bearing surfaces 18 and 21, and 19 and 20 are joined together, assuring a satisfactory supply of ink to the ball without causing an interruption of the ink flow if the cross-sectional area of the passageway 16 is reduced more than that of guide passageways formed in conventional ball point pens. After a prolonged period of use, the bearing surfaces 18 to 21 may be abraded, whereby the ball 13 may sink slightly into these surfaces. Nevertheless, the substantially hexagonal, elongate configuration of the passageway 16 and both the joining portions respectively between the bearing surfaces 18 and 21, 19 and 20 prevent it from being blocked by sinking of the ball 13.

As discussed above, the ball holder of the invention is provided with an ink reservoir in the bottom of the cavity, so that the ink supply to the ball is maintained. Since the ball bearing surfaces of the bottom of the cavity are inclined or sloped downwardly toward the center of the ink guide passageway, the ball can be supported in a stable manner in the central portion of the cavity. Supporting the ball by point contact enables an unbiased rotation of the ball. The cross section of the ink guide passageway prevents such passageway from being blocked by the ball which may tend to sink into these surfaces over a prolonged period of use. In one example, the cross-sectional dimension of the ink guide passageway may be chosen so that it has a length of 0.39 mm, a central width of h1 of 0.14 mm and a width at the opposite ends h2 of 0.07 mm for a ball point pen using a ball having a diameter of 0.4 mm, for example. In this example, the maximal width value h1 is twice the minimal width value h2.

What is claimed is:

1. A ball holder for a ball point pen comprising:

an elongate hollow ball holder body formed of a synthetic resin material, a ball trap socket for holding a ball in one end of the holder body in a rotatable manner and against removal, the socket being formed integrally with the holder body and having a cavity defined therein which holds the ball in a manner such that the ball partly projects through a tip end of the holder body, and an elongate ink guide passageway providing communication between the other end of the holder body and the bottom of the cavity, the passageway having an elongate configuration in cross section perpendicular to the axis of the passageway, said elongate cross section having a longitudinal length at least slightly less than the diameter of the ball and a width in the direction perpendicular to the length thereof which increases from its opposite longitudinal ends toward the center of the length, the bottom of the cavity being formed with four flat bearing surfaces all of which are inclined in a direction away from said one end of the holder body toward the center of the passageway, two of the four bearing surfaces being disposed on each side of the passageway and being directly joined with each other and being inclined toward each other, the ball being supported by contact with a point on each of the four bearing surfaces, the joining portions between the bearing surfaces defining an ink reservoir which communicates with the guide passageway.

2. A ball holder for a ball point type pen comprising: an elongate ball holder body having means therein defining a ball-retaining socket for rotatably retaining a ball in such manner that the ball partly portrudes from one end of the ball holder body; ball-supporting means disposed at the base of the socket for rotatably supporting the ball within the ball-retaining socket at a plurality of discrete point contact sites, the ball-supporting means comprising a plurality of discrete, substantially flat bearing surfaces each one of which makes point contact with the ball at one point contact site; and means defining an elongate ink passageway providing communication between the other end of the ball holder body and the ball-retaining socket, the ink passageway having an elongate cross section perpendicular to the longitudinal axis of the passageway, the elongate cross section having a length dimension approximately equal to the diameter of the ball and a width dimension which increases from a minimal value at the two opposite longitudinal ends of the elongate cross section to a maximal value at the center thereof, the plurality of bearing surfaces being arranged in two groups with one group on each side of the passageway, each of the bearing surfaces sloping in a direction away from the one end of the ball holder body toward the passageway and each two adjoining bearing surfaces on each side of the passageway sloping toward one another.

3. A ball holder according to claim 2; wherein the width dimension varies uniformly and progressively from the two opposite longitudinal ends to the center of the elongate cross section.

4. A ball holder according to claim 2; wherein the maximal value of the width of the elongate cross section is no greater than twice the minimal value.

5. A ball holder according to claim 2; wherein the plurality of flat bearing surfaces are arranged in two sets, one set of flat bearing surfaces being disposed on one side of the elongate cross section along the length thereof and the other set being disposed on the other side of the elongate cross section along the length thereof.

6. A ball holder according to claim 5; wherein the flat bearing surfaces of each set are all inclined toward the center of the elongate cross section.

* * * * *